US009052118B2

(12) United States Patent
Metcalf et al.

(10) Patent No.: US 9,052,118 B2
(45) Date of Patent: Jun. 9, 2015

(54) SLIDE RACK

(75) Inventors: Timothy A. Metcalf, Greeneville, TN (US); David Morton, Newport, TN (US)

(73) Assignee: SSW Holding Company, Inc., Fort Smith, AK (US)

( * ) Notice: Subject to any disclaimer, the term of this patent is extended or adjusted under 35 U.S.C. 154(b) by 0 days.

(21) Appl. No.: 13/374,042

(22) Filed: Dec. 8, 2011

(65) Prior Publication Data

US 2012/0145141 A1 Jun. 14, 2012

Related U.S. Application Data

(63) Continuation of application No. 12/260,616, filed on Oct. 29, 2008, now abandoned, which is a continuation of application No. 11/065,119, filed on Feb. 23, 2005, now abandoned.

(60) Provisional application No. 60/546,506, filed on Feb. 20, 2004.

(51) Int. Cl.
*F24C 15/16* (2006.01)

(52) U.S. Cl.
CPC ..... *F24C 15/16* (2013.01)

(58) Field of Classification Search
USPC ..... 126/339, 337 R, 332, 338, 340, 337 A, 126/333
See application file for complete search history.

(56) References Cited

U.S. PATENT DOCUMENTS

| | | | | |
|---|---|---|---|---|
| 1,206,730 A | | 11/1916 | Rideout | |
| 2,033,792 A | | 10/1930 | Sywert | |
| 2,033,861 A | | 7/1932 | Otte | |
| 1,896,307 A | | 2/1933 | Hatch | |
| 1,918,457 A | | 7/1933 | Dowell | |
| 1,946,532 A | | 2/1934 | Hatch | |
| 2,078,681 A | | 3/1935 | Otte | |
| 2,011,189 A | | 8/1935 | Anderson | |
| 2,033,859 A | | 3/1936 | Otte | |
| 2,466,360 A | | 4/1949 | Bitney | |
| 2,609,267 A | | 9/1952 | Hallock | |
| 2,644,588 A | | 7/1953 | Brown | |
| 2,724,630 A | | 11/1955 | Saunders | |
| 2,751,486 A | * | 6/1956 | Evans | 219/391 |
| 2,804,068 A | | 8/1957 | Miller | |
| 2,899,255 A | * | 8/1959 | Evans | 312/274 |
| 2,911,276 A | | 11/1959 | Hiers | |

(Continued)

FOREIGN PATENT DOCUMENTS

| | | |
|---|---|---|
| DE | 446 757 | 7/1927 |
| DE | 2036863 | 1/1972 |

(Continued)

*Primary Examiner* — Avinash Savani

(74) *Attorney, Agent, or Firm* — Varnum, Riddering, Schmidt & Howlett LLP

(57) ABSTRACT

An oven rack system has a two piece oven rack (100) with a cooking rack (102) and a base rack (104). The base rack (104) is adapted to remain stationary and may be positioned on ledges or other protrusions associated with inner liners of oven cavities. In one embodiment, a pair of angled pieces (118) extend between outer lateral braces (114) and a rear brace (106). The cooking rack (102) is adapted to slide on and be extendable relative to the base rack (104). A user can exert manual forces on the cooking rack (102) so as to move the cooking rack (102) relative to the base rack (104). The movement occurs in the absence of the requirement of any type of rotatable or rolling elements.

35 Claims, 8 Drawing Sheets

(56) References Cited

U.S. PATENT DOCUMENTS

| | | | | | |
|---|---|---|---|---|---|
| 3,012,554 | A | * | 12/1961 | Hirsch | 126/338 |
| 3,454,744 | A | | 7/1969 | Vonderhaar | |
| 3,791,371 | A | | 2/1974 | Oatley | |
| 4,194,495 | A | * | 3/1980 | Scherer | 126/339 |
| 4,357,522 | A | | 11/1982 | Husslein | |
| 4,651,713 | A | | 3/1987 | Ondrasik, II | |
| 5,209,572 | A | | 5/1993 | Jordan | |
| 5,299,557 | A | | 4/1994 | Braithwaite | |
| 5,746,118 | A | | 5/1998 | Brunner | |
| 5,768,982 | A | | 6/1998 | Violi | |
| 6,112,916 | A | | 9/2000 | Barnes | |
| 6,148,813 | A | | 11/2000 | Barnes | |
| 6,318,245 | B1 | | 11/2001 | Durth | |
| 6,491,173 | B1 | | 12/2002 | Costa | |
| 6,643,900 | B2 | | 11/2003 | Jahrling | |
| 6,789,861 | B1 | | 9/2004 | Dobberstein | |
| 6,938,617 | B2 | | 9/2005 | Le | |
| 7,216,646 | B2 | | 5/2007 | Le | |
| 7,316,179 | B2 | | 1/2008 | Geberzahn | |
| 2001/0044992 | A1 | | 11/2001 | Jahrling | |

FOREIGN PATENT DOCUMENTS

| | | |
|---|---|---|
| DE | 74 12 673 | 10/1975 |
| DE | 31 41 158 | 5/1983 |
| DE | 38 15 440 | 11/1989 |
| DE | 198 17 499 | 12/1999 |
| DE | 198 59 986 | 6/2000 |
| DE | 199 51 267 | 5/2001 |
| EP | 0 091 666 | 10/1983 |
| EP | 0 407 742 | 1/1991 |
| EP | 0 931 985 | 7/1999 |
| EP | 0 952 403 | 10/1999 |
| EP | 1 158 185 | 11/2001 |
| FR | 2266110 | 10/1975 |
| GB | 910 103 | 11/1962 |
| GB | 1 506 162 | 4/1978 |
| GB | 2 196 109 | 4/1988 |
| WO | WO01/30162 | 5/2001 |

* cited by examiner

SLIDE RACK

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention relates to oven-related products and, more particularly, products in the form of oven racks having one portion of the rack capable of sliding relative to another portion of the rack.

2. Background Art

Various types of oven racks are well known in the industry. For example, steel wire oven racks are often manufactured from a steel rod which is drawn, so as to form steel wire. These oven racks formed of steel wire products can be coated with various types of materials. Also, oven racks and other oven-related articles can be manufactured from products other than steel. Of course, any type of oven rack or similar product which is positioned within an oven cavity during use must be capable of withstanding normal cooking temperatures. In addition, for ovens which employ self-cleaning cycles, the oven racks and other oven-related articles located within the oven itself must be capable of being subjected to and withstanding temperatures which substantially exceed normal cooking temperatures. For example, steel wire oven racks may be subjected to temperatures above 900° F. associated with self cleaning cycles, common in today's kitchen ovens.

One difficulty which has existed for a number of years in the industry relates to manual manipulation of oven racks. In many conventional ovens, the oven racks can be positioned at various vertically disposed positions, and be adjustable among the same. With the oven racks positioned as desired at various vertically adjusted locations, the oven racks often "slide" on brackets positioned on the lateral sides of the oven cavity. These brackets or "ledges" may be separately manufactured and assembled components from the surfaces of the oven cavity and oven racks or, alternatively, may be integrated into the lateral surfaces of the oven cavity.

Oven racks can also be constructed of two pieces, where one piece is in the form of a slidable rack, and is capable of extension or retraction relative to a base rack. The base rack can interact with the ledges or lining of the interior cavity of the oven or range to form a support base for the cooking rack. It is known to utilize ball bearing configurations for purposes of achieving extension capability. However, the use of ball bearings or similar elements is relatively expensive. In the prior art, oven racks exist having extension capabilities and using ball bearings or "wire on oven liner" relationships to facilitate extension.

SUMMARY OF THE INVENTION

In accordance with the invention, an oven rack system is provided for use in a cooking environment, such as an oven cavity. The system includes a base rack adapted to be horizontally positioned within the cavity, and further adapted to be maintained in a stationary position. A cooking rack is adapted to be engaged with the base rack and further adapted to support items to be cooked. The cooking rack is sized and structured so as to be manually extendable and retractable relative to the base rack, in the absence of ball bearings, rollers or other rotatable or rolling elements engaged between the base rack and the cooking rack.

During extension and retraction of the cooking rack relative to the base rack, certain elements of the cooking rack are in sliding engagement with certain other elements of the base rack. The base rack and the cooking rack can be composed of formed steel wire products. Alternatively, components of the cooking rack and the base rack can be composed of formed steel wire products and formed sheet metal components, respectively.

The oven rack system can include a stop mechanism, for limiting the extension of the cooking rack relative to the base rack. The cooking rack can include a handle for facilitating manual manipulation of the rack, when extending or retracting the rack relative to the base rack.

The oven rack system can include means for limiting rearward movement of food items placed on the cooking rack. The base rack can be adapted to be positioned on ledges, rails or other protrusions associated with an inner liner of the oven cavity.

The base rack can include a series of transverse supports. A plurality of lateral supports can extend horizontally from a front to a back of the base rack. The lateral supports can be secured to the transverse supports. Each of the lateral supports can be coupled to a corresponding outer lateral brace through a forward connection. The base rack can include a plurality of angled pieces extending between outer lateral braces and a rear brace. The angled configuration can assist in preventing items placed on the cooking rack from falling off of the rack over the rear brace.

The cooking rack can include a series of opposing lugs comprising upstanding members. The cooking rack can also include a front brace, having opposing left and right side portions, providing a forward bracing means for the cooking rack. A handle can be integrated with the front brace.

When the cooking rack is in a retracted position on the base rack, ends of the rear brace of the cooking rack extend outwardly and under lateral angled pieces of the base rack. Lugs extend upwardly adjacent lateral angled braces of the base rack, and are intermediate to angled pieces and outer lateral braces of the base rack. When manual forces are exerted on a front of the cooking rack, so as to move the cooking rack in an extended movement, the rear brace of the cooking rack is positioned so that it remains below the lateral angled brace of the base rack, with the lugs being adjacent the angled braces. As the cooking rack is further extended to a fully extended position, abutment of the lugs against the angled sections of the angled braces prevent any further extended movement of the cooking rack.

Still further, the oven rack system includes a means for preventing the cooking rack from inadvertent cantilever relative to the base rack, when the cooking rack is in an extended position. The cooking rack can include a series of lateral braces, and the base rack can include a series of lower lateral supports. When the cooking rack is extended or retracted relative to the base rack, the lateral braces of the cooking rack ride on lower lateral supports of the base rack.

In accordance with another aspect of the invention, the oven rack system includes a plurality of formed sheet metal channels, with the cooking rack riding in the channels. Each of the formed sheet metal channels includes at least one detent positioned between ends of the channels. When the cooking rack is extended relative to the base rack, angled pieces of the cooking rack are captured by the detents in the channels, thus preventing further extension of the cooking rack relative to the base rack.

BRIEF DESCRIPTION OF THE SEVERAL VIEWS OF THE DRAWING

The invention will now be described with respect to the drawings, in which.

DETAILED DESCRIPTION OF THE INVENTION

Figure 1:
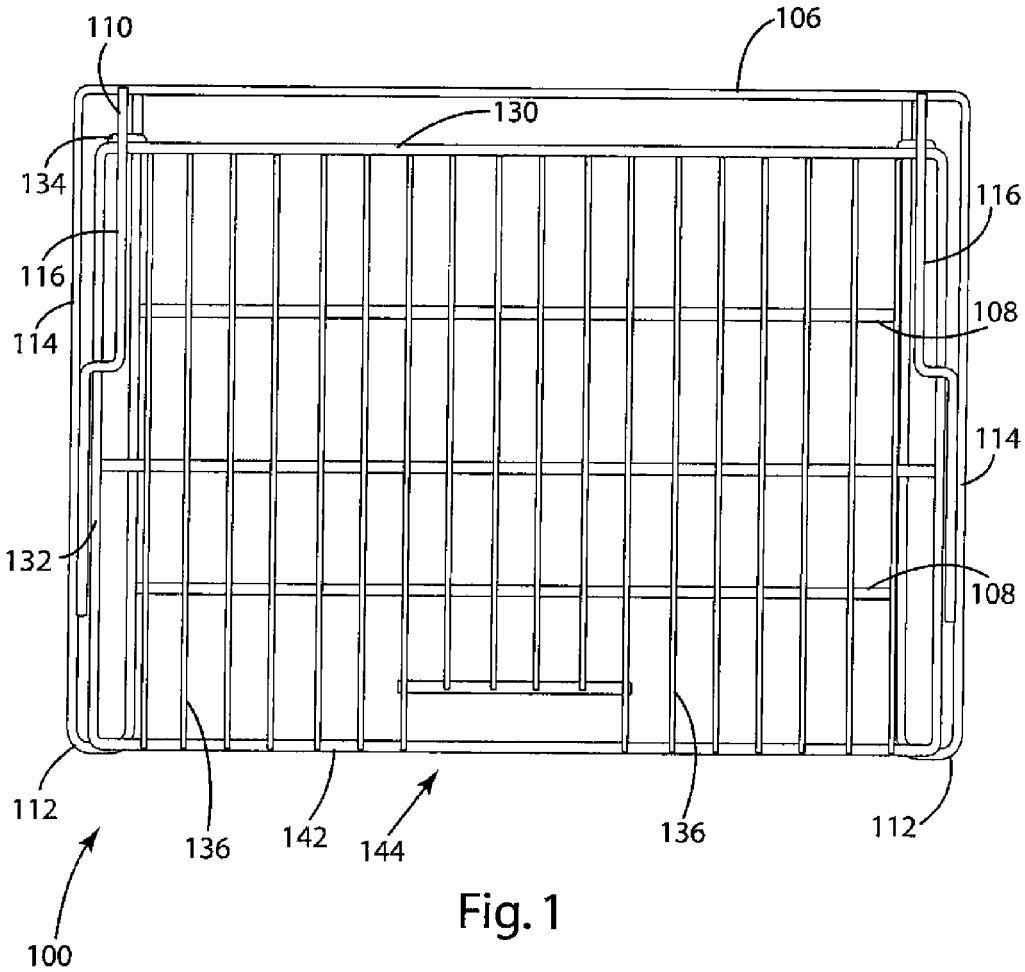
FIG. 1 is a plan view of a two piece oven rack in accordance with the invention.

The principles of the invention are disclosed, by way of example, in two embodiments of "oven rack systems" referred to herein as two piece oven racks as described herein and illustrated in FIGS. 1-24. The primary concept of the invention relates to the use of an oven rack having a cooking rack and a base rack, where the cooking rack may be slidably extended or retracted relative to the base rack, without the necessity of ball bearings or other expensive components.

More specifically, and first with respect to FIGS. 1-12, a first embodiment of a two piece oven rack 100 is illustrated in accordance with the invention. The two piece oven rack 100 includes a cooking rack 102 (shown in a stand alone configuration in FIGS. 7-8B) and a base rack 104 (shown in a stand alone configuration in FIGS. 9-12). Referring specifically to the base rack 104, the rack 104 includes an elongated rear brace 106 which extends horizontally along the back of the base rack 104. The elongated rear brace will be positioned adjacent the rear of the oven cavity. It should be emphasized that the base rack 104 is adapted to remain stationary and may be positioned on ledges or other protrusions associated with the inner liners of the oven cavities.

Parallel to the rear brace 106 and extending transversely across the base rack 104 near its middle and substantially near its front are a pair of transverse supports 108. Correspondingly, a pair of lateral supports 110 are also provided. The lateral supports 110 extend horizontally from the front to the back of the base rack 104. The lateral supports 110 are welded or otherwise secured to the outer lateral supports 110.

Each of the lateral supports 110 is coupled to a corresponding outer lateral brace 114 through a forward connection 112. As shown in the drawings, the outer lateral braces 114 and the lateral supports 110 are horizontally disposed and essentially parallel to each other. Also associated with the base rack 104 are a pair of angled pieces 118 which extend between the outer lateral braces 114 and the rear brace 106. The angled configuration of the pieces 118 assist in preventing items placed on the cooking rack 102 from falling off of the rack 102 over the rear brace 106. In the particular embodiment of the base rack 104 illustrated in FIGS. 1-12, the base rack 104 can be manufactured in a conventional manner of steel wire products or the like.

As shown in FIGS. 1, 2 and 6-8B, the two piece oven rack 100 also includes a cooking rack 102. The cooking rack 102 is adapted to slide on and be extendable relative to the base rack 104. With reference to the drawings, the base rack 104 includes an elongated rear brace 130 which is positioned adjacent the rear of the oven cavity when the cooking rack 102 is in its retracted and normal position within the oven cavity (not shown). The rear brace 130 and other components of the cooking rack 102 can be manufactured in a conventional manner of steel wire products or the like.

Interconnected or otherwise integral with the rear brace 130 are a pair of lateral braces 132, with one positioned on the right side of the cooking rack 102 and the other one positioned on the outer left side of the cooking rack 102. Each of the lateral braces 162 extend perpendicular to the rear brace 130 and extend between the forward and rear sections of the cooking rack 102. These lateral braces 132 essentially act as support braces for other elements of the cooking rack 102. Each of the lateral braces 132 is parallel to the other one of the lateral braces 132.

At the rear portion of the cooking rack 102, and connected in any suitable manner to the rear brace 130, are a pair of opposing lugs 134. The lugs include upstanding members which are primarily shown in FIGS. 7, 8A and 8B.

Positioned intermediate the pair of opposing lateral braces 132 are a series of parallel and longitudinally extending elongated support members 136. These support members 136 act as principal support members of the cooking rack 102 for supporting items to be heated and cooked within the oven cavity (not shown). The rear ends of the support members 136 are connected to the rear brace 130 by suitable means, such as spot welding or the like.

Further, the cooking rack 102 includes a cross member 138 positioned substantially near the middle between the front and rear portions of the cooking rack 102. Still further, the cooking rack 102 includes a pair of angled pieces 140 extending between the lateral braces 132 and the rear brace 130. The angled configuration of the pieces 140 assists in preventing items placed on the support members 136 from falling off of the cooking rack 102 over the rear brace 130. The cross member 138 extends perpendicular to the pair of opposing lateral braces 132. The cross member 138 provides for additional support for items placed on the cooking rack 102 for purposes of heating or cooking. The cross member 138 may be connected to the support members 136 and lateral braces 132 in any conventional manner. For example, spot welding may be utilized.

In addition to the foregoing, the cooking rack 102 also includes a front brace 142. The front brace 142 includes left and right side portions, providing a forward bracing means for the cooking rack 102. Still further, the cooking rack 102 may include a handle 144. The handle 144 may be interconnected to the front brace 142 (and, in fact, form a part thereof) and certain of the support members 136. The handle 144 is described in U.S. Provisional Patent Application Ser. No. 60/496,885.

Figure 2:
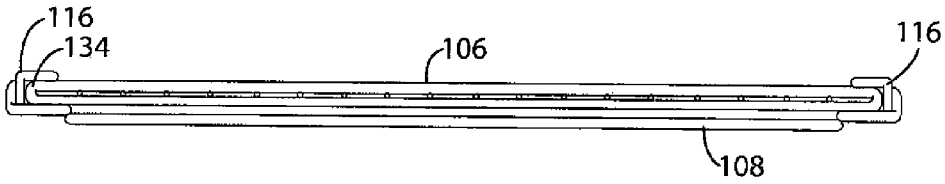
FIG. 2 is a front elevation view of the oven rack shown in FIG. 1.
Figure 3:
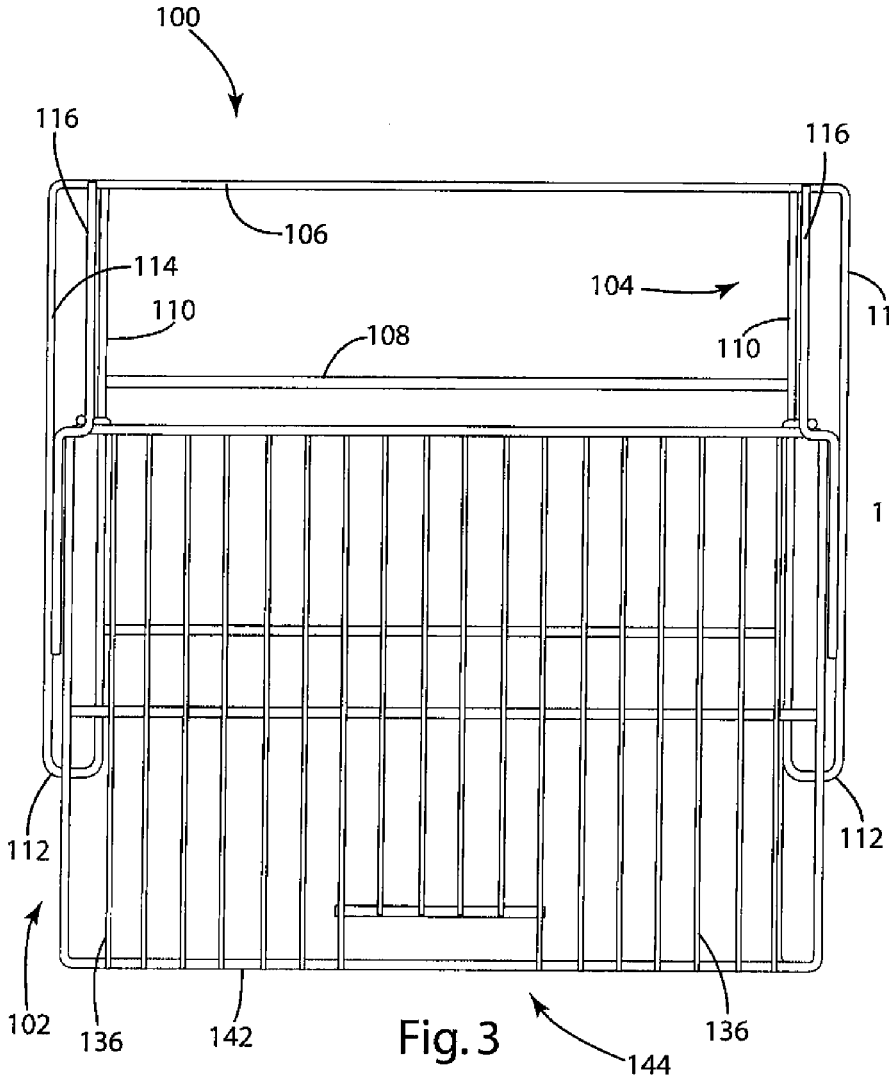
FIG. 3 is a plan view of the oven rack shown in FIG. 1, but with the cooking rack in an extended state.
Figure 5:
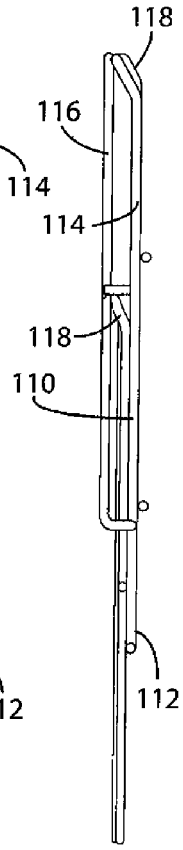
FIG. 5 is a side elevation view of the oven rack shown in FIG. 3, in an extended state.
Figure 4:
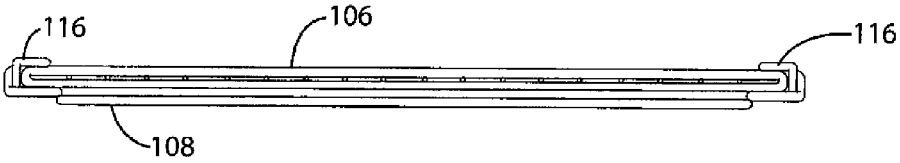
FIG. 4 is a front elevation view of the oven rack in the extended state, as shown in FIG. 3.
Figure 6:
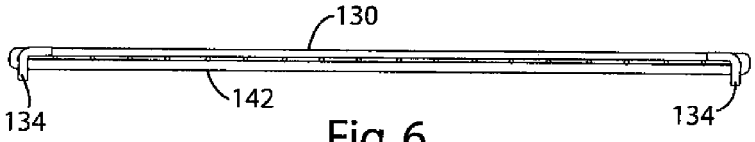
FIG. 6 is a rear elevation view of the cooking rack of the oven rack shown in FIG. 1.
Figure 7:
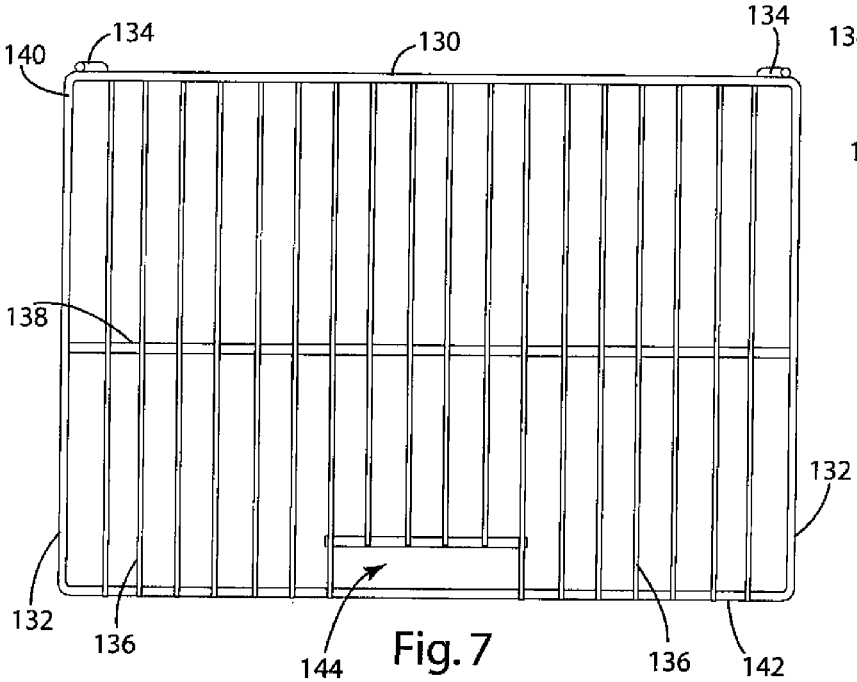
FIG. 7 is a plan view of the cooking rack shown in FIG. 6.
Figure 8B:
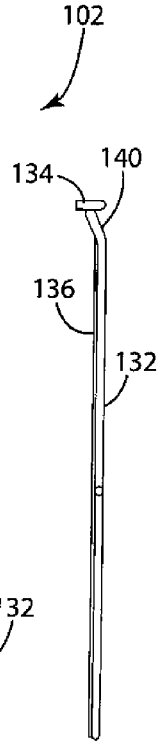
FIG. 8B is a side elevation view of the cooking rack shown in FIG. 7.
Figure 8A:
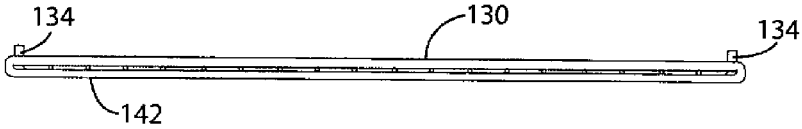
FIG. 8A is a front elevation view of the cooking rack shown in FIG. 7.
Figure 9:
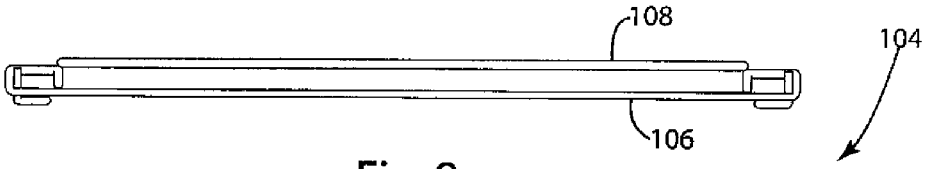
FIG. 9 is a rear elevation view of the base rack of the two piece oven rack shown in FIG. 1.
Figure 10:
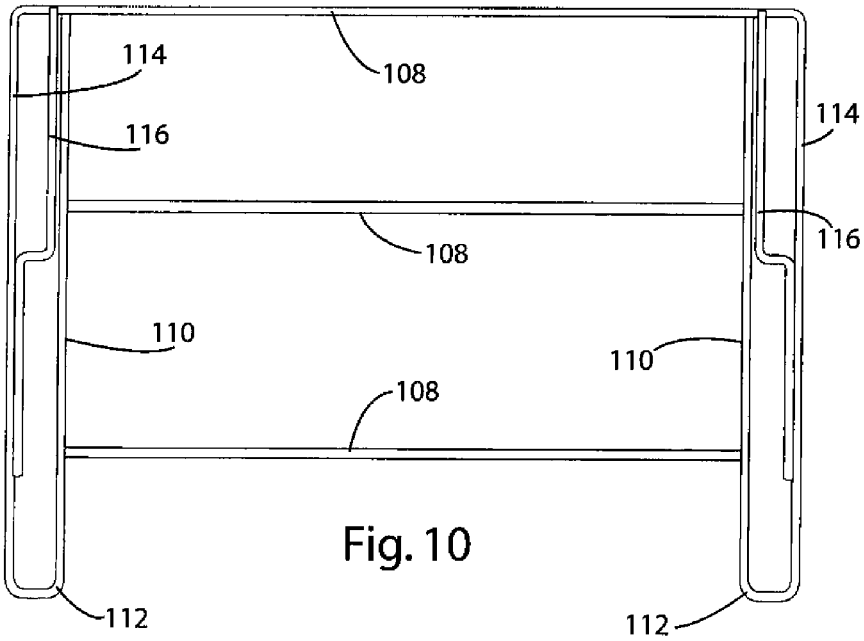
FIG. 10 is a plan view of the base rack shown in FIG. 9.
Figure 12:
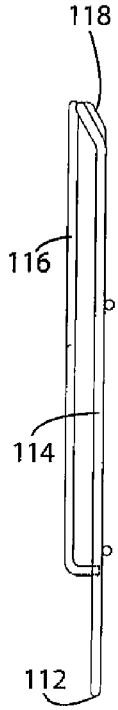
FIG. 12 is a side elevation view of the base rack shown in FIG. 10.
Figure 11:
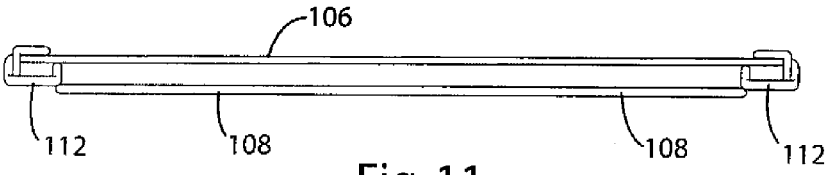
FIG. 11 is a front elevation view of the base rack shown in FIG. 10.

The operation of the oven rack 100 will now be described. The oven rack 100 is illustrated with the cooking rack 102 in a retracted position on the base rack 104 in FIGS. 1 and 2. With this configuration, the cooking rack is essentially supported by the base rack 104. In this configuration, and as shown in FIGS. 1 and 2, the ends of the rear brace 130 of the cooking rack 102 extend outwardly and under the lateral angled braces 116 of the base rack 104. Correspondingly, the lugs 134 extend upwardly adjacent the lateral angled braces 116 of the brace rack 104, and are intermediate the angled pieces 116 and the outer lateral braces 114 of the base rack 104. When it is desired to extend the cooking rack 102 relative to the base rack 104, manual forces can be exerted on the handle 144 so as to move the cooking rack 102 in a "downward" direction as illustrated in FIG. 3. With this extended movement, the cooking rack 102 essentially "slides" on the base rack 104. As noted, the rear brace 130 of the cooking rack 102 is positioned so that it remains below the lateral angled braces 116 of the base rack 104, with the lugs 134 adjacent the angled braces 116. Further, as the cooking rack 102 is shown extended to a fully extended position in FIG. 3, the abutment of the lugs 134 against the angled sections of the angled braces 116 prevent any further extended movement of the cooking rack 102. In addition, the lateral angled braces 116 and the lugs 134 prevent the cooking rack 102 to inadvertently "cantilever" based on forces or weight placed on the support members 136. Also, with this configuration, the lateral braces 132 of the cooking rack 102 essentially "ride on" the lower lateral supports 110 of the base rack 104.

A second embodiment of a slide rack in accordance with the invention is illustrated in FIGS. 13-24, and is identified as two piece oven rack 160. The two piece oven rack 160 is shown in the drawings as utilizing sheet metal components, rather than wire. Also, the two piece oven rack 160 has a slightly different configuration than the two piece oven rack 100 previously described herein. Both oven racks, however, provide for extension of a cooking rack relative to a base rack, and also provide a stop mechanism for the cooking rack during extension. It should also be mentioned that the oven racks may have various finishes, including, but not limited to nickel and porcelain. Also, as previously described, each of the oven racks may utilize a handle or the like, including the handle identified in U.S. Provisional Patent Application Ser. No. 60/496,885. Still further, the oven racks 100 and 160 may be utilized in conventional ovens, traditional household ranges, commercial ovens, barbeque grills and similar structures.

Referring to the two piece oven rack 160, and FIGS. 13-24, the two piece oven rack 160 includes a base rack 161 and a cooking rack 163. The base rack 161 is composed of formed sheet metal components. Referring primarily to FIGS. 21-24, the base rack 161 includes a rear brace 162 extending across the rear of the base rack 161 in a horizontally disposed manner. The rear brace 162 will be positioned adjacent the rear of an oven liner or the like. As with the base rack 104, the base rack 161 includes a pair of transverse supports 164 extending parallel to the rear brace 162. Rear brace 162 and transverse supports 164 are connected to lower lateral supports 168, which extend between the forward and rear ends of the base rack 161. The lower lateral supports 168 form into each of a pair of outer lateral braces 172. A pair of angled pieces 178 extend between the outer lateral braces 172 and the rear brace 162, for purposes of providing somewhat of a "back stop" for food items which will be placed on the cooking rack 163. The base rack 161 further includes a pair of horizontally disposed and formed sheet metal channels 174. One of each of the and formed sheet metal channels 174 is positioned on a lateral side of the base rack 161. As shown primarily in FIGS. 22 and 24, each of the and formed sheet metal channels 174 includes a detent 176 positioned substantially intermediate the ends of the and formed sheet metal channels 174. As will be described in subsequent paragraphs herein, the detents 176 act as "stops" for extension of the cooking rack 163.

The cooking rack 163 associated with the two piece oven rack 160 has a configuration substantially similar to the cooking rack 102 previously described herein. However, these respective cooking racks differ in that the cooking rack 102 includes the previously described set of lugs 134 positioned at the rear portion of the cooking rack 102. Accordingly, given the similarities, reference numerals illustrated in FIGS. 13-24 with respect to the cooking rack 163 correspond to like elements of the cooking rack 102. That is, the cooking rack 102 includes a rear brace 130 and lateral braces 132. As earlier stated, lugs 134 associated with the cooking rack 102 do not exist with respect to the cooking rack 163. However, the cooking rack 163 also includes support members 136 and a cross member 138. The cooking rack 163 further includes the angled pieces 140, front brace 142 and handle 144.

Figure 13:
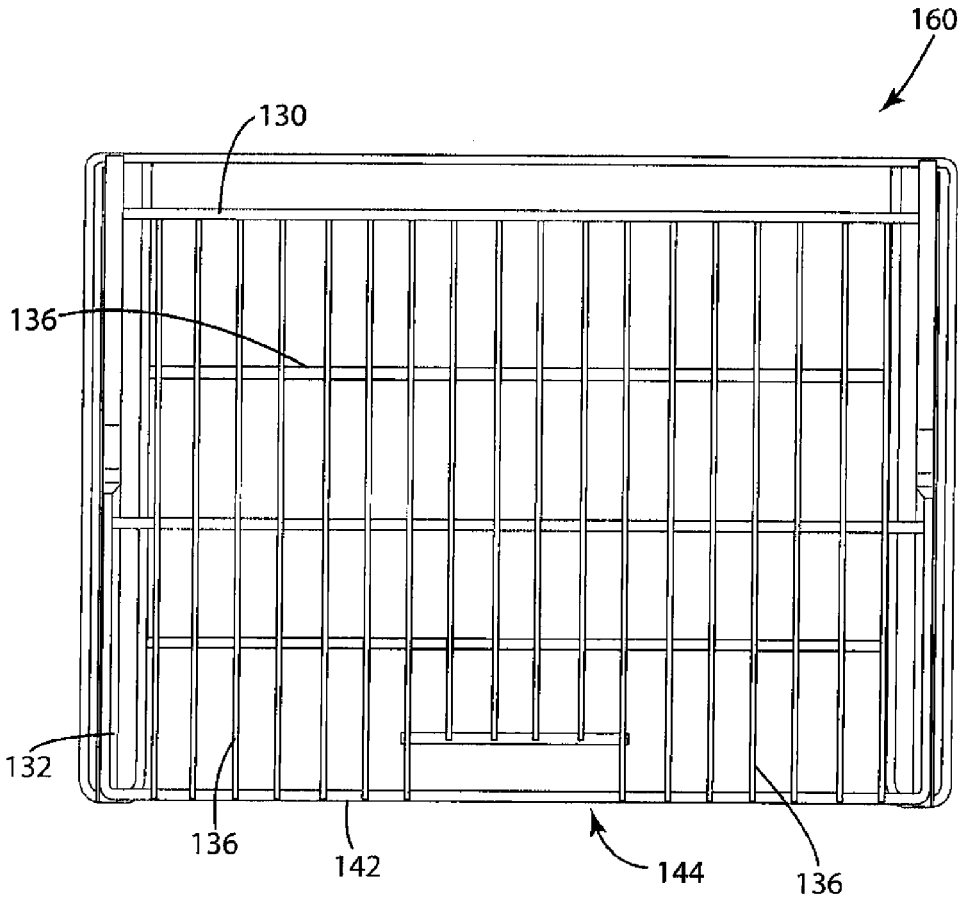
FIG. 13 is a plan view of a second embodiment of a two piece oven rack in accordance with the invention, with the rack utilizing sheet metal components.
Figure 14:
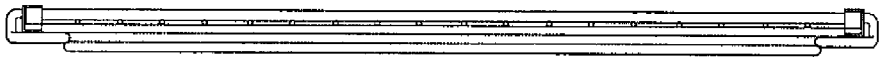
FIG. 14 is a front elevation view of the oven rack shown in FIG. 13.
Figure 15:
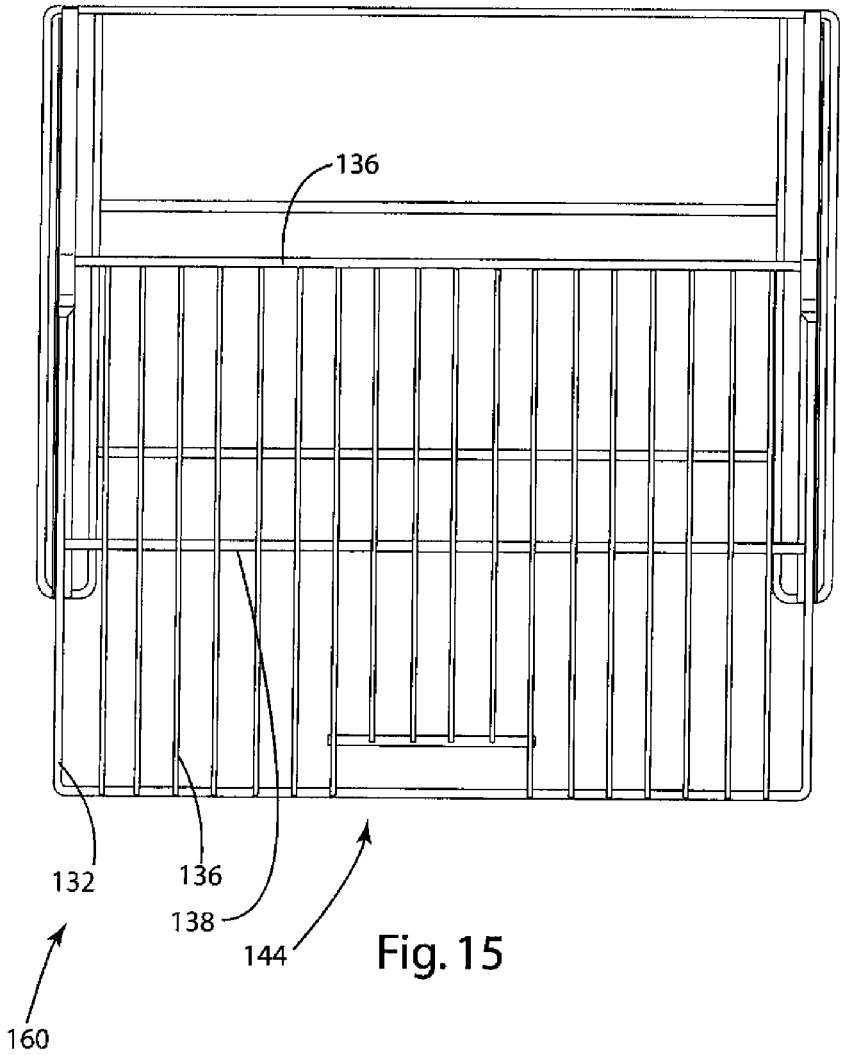
FIG. 15 is a plan view of the oven rack shown in FIG. 13, but with the cooking rack in an extended state.
Figure 17:
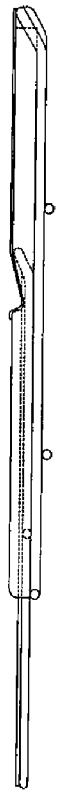
FIG. 17 is a side elevation view of the oven rack shown in FIG. 15, in an extended state.
Figure 16:
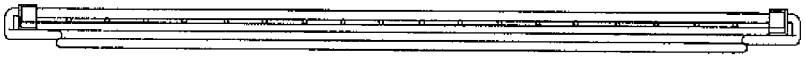
FIG. 16 is a front elevation view of the oven rack shown in FIG. 15, in the extended state.
Figure 18:
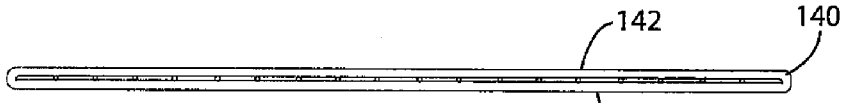
FIG. 18 is a rear elevation view of the cooking rack shown in the oven rack of FIG. 13.
Figure 19:
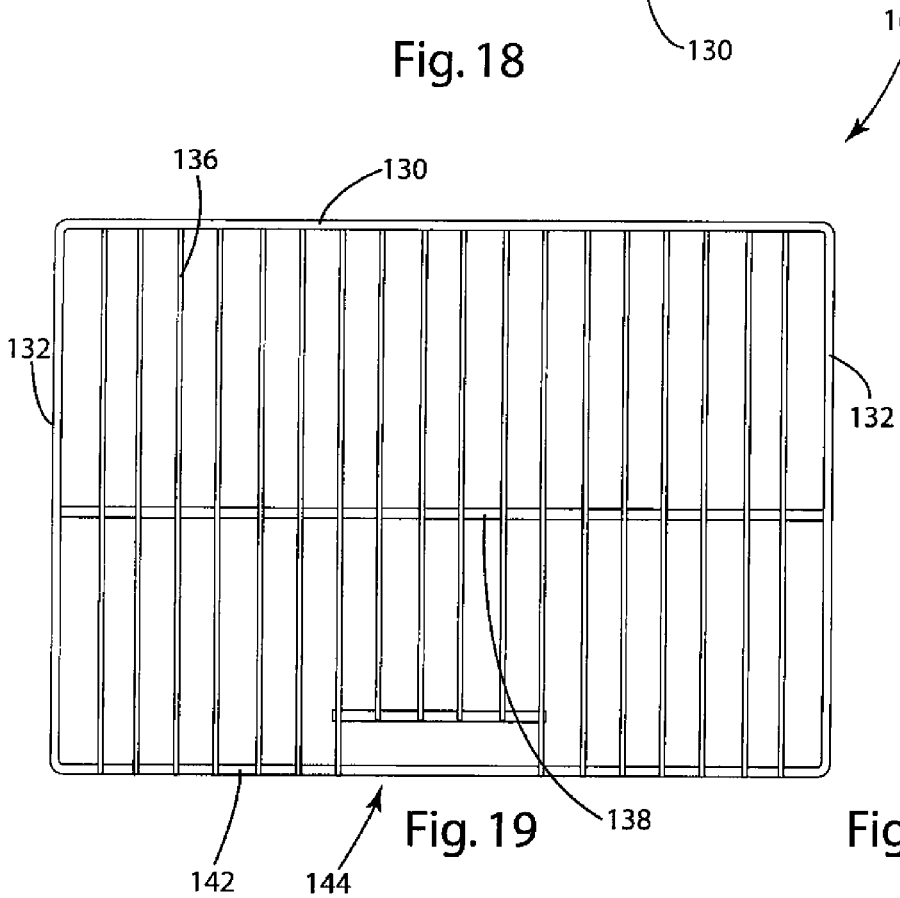
FIG. 19 is a plan view of the cooking rack shown in FIG. 18.
Figure 20B:
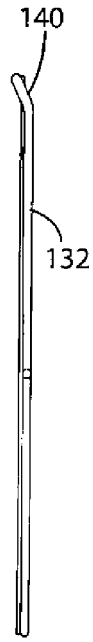
FIG. 20B is a side elevation view of the cooking rack shown in FIG. 19.
Figure 20A:
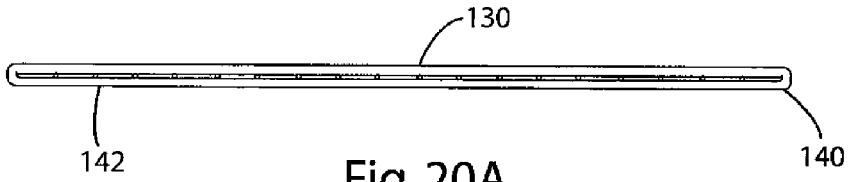
FIG. 20A is a front elevation view of the cooking rack shown in FIG. 19.
Figure 21:
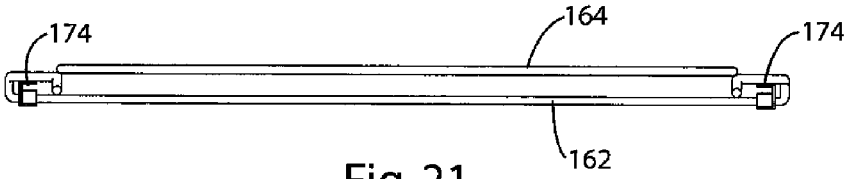
FIG. 21 is a rear elevation view of the base rack of the oven rack shown in FIG. 13.
Figure 22:
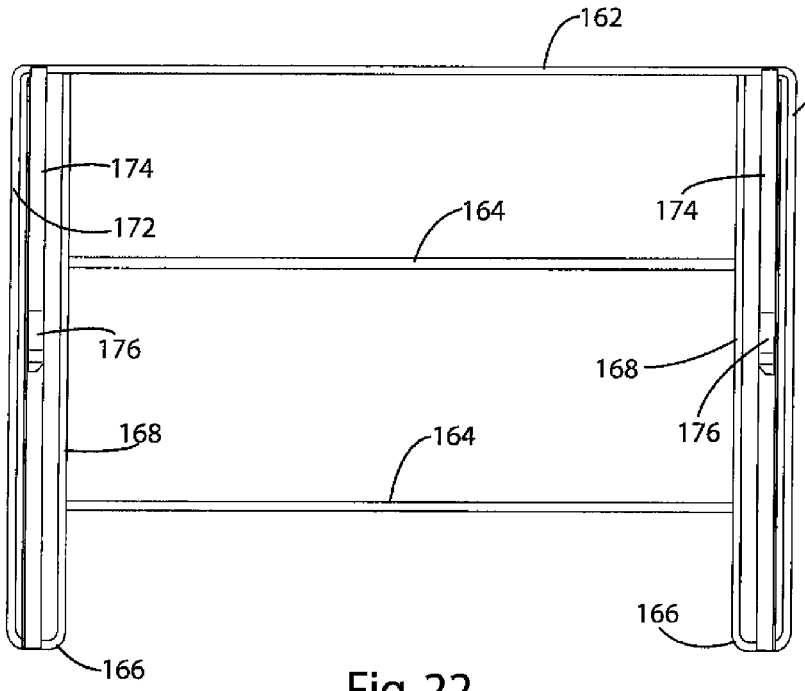
FIG. 22 is a plan view of the base rack shown in FIG. 21.
Figure 24:
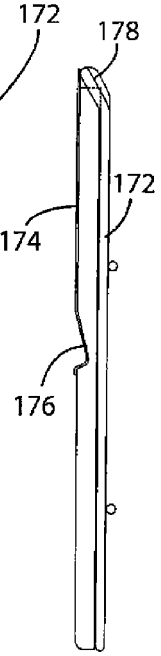
FIG. 24 is a side elevation view of the base rack shown in FIG. 22.
Figure 23:
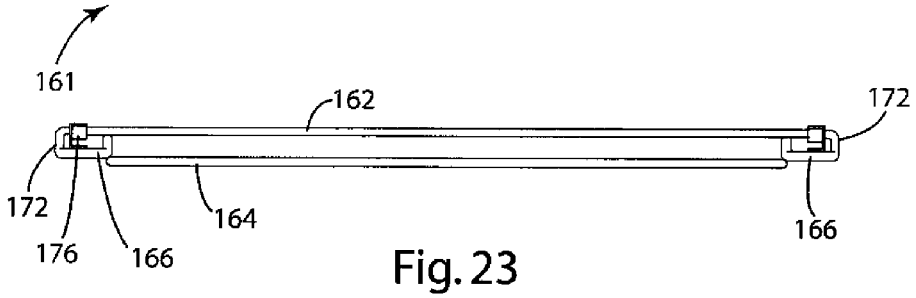
FIG. 23 is a front elevation view of the base rack shown in FIG. 22.

The operation of the oven rack 160 will now be described. The oven rack 160 is shown in FIG. 13 with the cooking rack 163 in a fully retracted position relative to the base rack 161. In this position, the ends of the rear brace 130 are positioned below the upper support rods 174 of the base rack 161. Further, the cooking rack 163 essentially rests and "rides on" the formed sheet metal channels 174. The cooking rack 163 is shown in a fully extended position in FIG. 15 relative to the base rack 161. In this position, the angled pieces 140 of the cooking rack 163 are essentially "captured" by the detents 176 in the and formed sheet metal channels 174 of the base rack 161. This capture essentially acts as a "stop" to prevent any further extension of the cooking rack 163 relative to the base rack 161. The complete structural relationship between the cooking rack 163 and the base rack 161 is further shown in FIGS. 15-24.

In accordance with the foregoing, two piece oven racks have been shown which allow a cooking rack to slide or achieve extension relative to a base rack, for easier handling of and access to items being placed in and out of an oven or range. As described, the oven racks comprise a cooking rack and a base rack. The base rack essentially interacts with the lining of the interior cavity of an oven or range, so as to form a support base for the cooking rack. The cooking rack can then be placed in the base rack with an extension feature. As also previously described, traditional extension sliding oven racks utilize costly ball bearings to achieve extension capability. Oven rack systems in accordance with the invention eliminate the need for ball bearings or other rotatable elements. Also, the oven rack systems do not require any gliding interaction between the oven rack system portions and the walls or liners of the oven cavity. Further, oven racks in accordance with the invention can be adapted to fit various types and sizes of oven cavities. The particular oven rack embodiments described herein utilize "wire on wire" or "wire on sheet metal" relationships to facilitate extension. As previously described, conventional and well known traditional extension racks utilize ball bearings or wire on an oven liner relationship to facilitate extension.

As also described herein, the oven rack systems in accordance with the invention may utilize wire, sheet metal components, or other types of arrangements on the base rack to provide for stabilization for the cooking rack. In addition, a stop mechanism is provided for the cooking rack during extension. Still further, oven racks in accordance with the invention may have various finishes and may utilize components such as handles. As also previously described, oven racks in accordance with the invention may be utilized in traditional household ranges, commercial ovens, barbeque grills and other types of cooking structures.

It will be apparent to those skilled in the pertinent arts that other embodiments of oven rack systems in accordance with the invention can be designed. That is, the principles of an oven rack system are not limited to the specific embodiments described herein. Accordingly, it will be apparent to those skilled in the art that modifications and other variations of the above-described illustrative embodiments of the invention may be effected without departing from the spirit and scope of the novel concepts of the invention.

What is claimed is:

1. An oven rack system adapted for use in a cooking environment, such as an oven cavity, said oven rack comprising:

a base rack adapted to be horizontally positioned within said oven cavity, and further adapted to be maintained in a stationary position;

a cooking rack adapted to be engaged with said base rack and further adapted to support items to be cooked;

said cooking rack is sized and structured so as to be manually extendable and retractable relative to said base rack, in the absence of ball bearings, rollers, or other rotatable or rolling elements directly or indirectly engaged between said base rack and said cooking rack;

said cooking rack comprises:

a rear brace positioned adjacent a rear portion of said base rack, when said cooking rack is in a retracted position;

a plurality of lateral braces positioned on sides of said cooking rack, and extending between forward and rear sections of said cooking rack, said lateral braces acting as support braces for other elements of said cooking rack;

a plurality of opposing lugs comprising upstanding members; and a plurality of elongated support members acting as principal support elements of said cooking rack for supporting items to be cooked on said cooking rack.

2. An oven rack system in accordance with claim 1, characterized in that said cooking rack is extendable and retractable in the absence of any gliding movement of any portion of said oven rack system on walls or liners of said cavity, or other dynamic frictional interaction between said oven rack portions and said walls or liners.

3. An oven rack system in accordance with claim 1, characterized in that during extension and retraction of said cooking rack relative to said base rack, certain elements of said cooking rack are in a sliding engagement with certain other elements of said base rack.

4. An oven rack system in accordance with claim 1, characterized in that components of said base rack and said cooking rack are formed of steel wire products.

5. An oven rack system in accordance with claim 1, characterized in that components of said base rack and said cooking rack are composed of formed steel wire products and formed sheet metal components.

6. An oven rack system in accordance with claim 1, characterized in that said oven rack system comprises a stop mechanism for limiting the extension of said cooking rack relative to said base rack.

7. An oven rack system in accordance with claim 1, characterized in that said cooking rack further comprises a handle for facilitating manual manipulation of said cooking rack when extending or retracting said cooking rack relative to said base rack.

8. An oven rack system in accordance with claim 1, characterized in that said oven rack system further comprises means for limiting rearward movement of food items placed on said cooking rack.

9. An oven rack system in accordance with claim 1, characterized in that said base rack is adapted to be positioned on ledges or other protrusions associated with an inner liner of said oven cavity.

10. An oven rack system in accordance with claim 1, characterized in that said base rack comprises:

a plurality of transverse supports; and a plurality of lateral supports extending horizontally from a front to a back of said base rack, said lateral supports being secured to said transverse supports.

11. An oven rack system in accordance with claim 10, characterized in that:

each of said lateral supports is coupled to a corresponding outer lateral brace through a forward connection; and said base rack further comprises a plurality of angled pieces extending between outer lateral braces and a rear brace, said angled configuration assisting in preventing items placed on said cooking rack from falling off of said rack over said rear brace.

12. An oven rack system in accordance with claim 1, characterized in that said cooking rack further comprises a plurality of angled pieces extending between said lateral braces and said rear brace, said angled configuration assisting in preventing items placed on said support members from falling off of said cooking rack over said rear brace.

13. An oven rack system in accordance with claim 12, characterized in that said cooking rack further comprises:

a front brace having opposing left and right side portions, providing a forward bracing means for said cooking rack; and a handle integrated with said front brace.

14. An oven rack system in accordance with claim 1, characterized in that said oven rack comprises means for preventing said cooking rack from inadvertent cantilever relative to said base rack, when said cooking rack is in an extended position and based on forces or weight placed on support members of said cooking rack.

15. An oven rack system in accordance with claim 1, characterized in that:

said cooking rack comprises a plurality of lateral braces;

said base rack comprises a plurality of lower lateral supports; and when said cooking rack is extended or retracted relative to said base rack, said lateral braces of said cooking rack ride on said lower lateral supports of said base rack.

16. An oven rack system in accordance with claim 1, characterized in that said oven rack system further comprises a plurality of formed sheet metal channels, with said cooking rack riding in said formed sheet metal channels.

17. An oven rack system in accordance with claim 16, characterized in that each of said formed sheet metal channels includes at least one detent positioned between ends of said channels.

18. An oven rack system in accordance with claim 17, characterized in that when said cooking rack is extended relative to said base rack, angled pieces of said cooking rack are captured by said detents in said channels of said base rack, thus preventing further extension of said cooking rack relative to said base rack.

19. An oven rack system adapted for use in a cooking environment, such as an oven cavity, said oven rack comprising:

a base rack adapted to be horizontally positioned within said oven cavity, and further adapted to be maintained in a stationary position;

a cooking rack adapted to be engaged with said base rack and further adapted to support items to be cooked;

said cooking rack is sized and structured so as to be manually extendable and retractable relative to said base rack, in the absence of ball bearings, rollers, or other rotatable or rolling elements directly or indirectly engaged between said base rack and said cooking rack;

when said oven rack is in a retracted position on said base rack, ends of a rear brace of said cooking rack extend outwardly and under lateral angled braces of said base rack, and lugs extend upwardly adjacent lateral angled braces of said base rack, and are intermediate to angled pieces and outer lateral braces of said base rack; and when manual forces are exerted on a front of said cooking rack so as to move said cooking rack in an extended movement, said rear brace of said cooking rack is positioned so that it remains below said lateral angled braces of said base rack, with said lugs being adjacent to said angled braces of said base rack.

20. An oven rack system in accordance with claim 19, characterized in that said cooking rack is extendable and retractable in the absence of any gliding movement of any portion of said oven rack system on walls or liners of said cavity, or other dynamic frictional interaction between said oven rack portions and said walls or liners.

21. An oven rack system in accordance with claim 19, characterized in that during extension and retraction of said cooking rack relative to said base rack, certain elements of said cooking rack are in a sliding engagement with certain other elements of said base rack.

22. An oven rack system in accordance with claim 19, characterized in that components of said base rack and said cooking rack are formed of steel wire products.

23. An oven rack system in accordance with claim 19, characterized in that components of said base rack and said cooking rack are composed of formed steel wire products and formed sheet metal components.

24. An oven rack system in accordance with claim 19, characterized in that said oven rack system comprises a stop mechanism for limiting the extension of said cooking rack relative to said base rack.

25. An oven rack system in accordance with claim 19, characterized in that said cooking rack further comprises a handle for facilitating manual manipulation of said cooking rack when extending or retracting said cooking rack relative to said base rack.

26. An oven rack system in accordance with claim 19, characterized in that said oven rack system further comprises means for limiting rearward movement of food items placed on said cooking rack.

27. An oven rack system in accordance with claim 19, characterized in that said base rack is adapted to be positioned on ledges or other protrusions associated with an inner liner of said oven cavity.

28. An oven rack system in accordance with claim 19, characterized in that said base rack comprises:

a plurality of transverse supports; and a plurality of lateral supports extending horizontally from a front to a back of said base rack, said lateral supports being secured to said transverse supports.

29. An oven rack system in accordance with claim 28, characterized in that:

each of said lateral supports is coupled to a corresponding outer lateral brace through a forward connection; and said base rack further comprises a plurality of angled pieces extending between outer lateral braces and a rear brace, said angled configuration assisting in preventing items placed on said cooking rack from falling off of said rack over said rear brace.

30. An oven rack system in accordance with claim 19, characterized in that said oven rack comprises means for preventing said cooking rack from inadvertent cantilever relative to said base rack, when said cooking rack is in an extended position and based on forces or weight placed on support members of said cooking rack.

31. An oven rack system in accordance with claim 19, characterized in that:

said cooking rack comprises a plurality of lateral braces;

said base rack comprises a plurality of lower lateral supports; and when said cooking rack is extended or retracted relative to said base rack, said lateral braces of said cooking rack ride on said lower lateral supports of said base rack.

32. An oven rack system in accordance with claim 19, characterized in that said oven rack system further comprises a plurality of formed sheet metal channels, with said cooking rack riding in said formed sheet metal channels.

33. An oven rack system in accordance with claim 32, characterized in that each of said formed sheet metal channels includes at least one detent positioned between ends of said channels.

34. An oven rack system in accordance with claim 33, characterized in that when said cooking rack is extended relative to said base rack, angled pieces of said cooking rack are captured by said detents in said channels of said base rack, thus preventing further extension of said cooking rack relative to said base rack.

35. An oven rack system in accordance with claim 19, characterized in that as said cooking rack is further extended to a fully extended position, abutment of said lugs against angled sections of said angled braces of said base rack prevent any further extended movement of said cooking rack.

* * * * *